United States Patent [19]

Stella

[11] Patent Number: 4,645,323

[45] Date of Patent: Feb. 24, 1987

[54] FILM PROCESSOR

[75] Inventor: Joseph A. Stella, Peabody, Mass.

[73] Assignee: Polaroid Corporation, Cambridge, Mass.

[21] Appl. No.: 840,074

[22] Filed: Mar. 17, 1986

[51] Int. Cl.[4] ..... G03D 5/06

[52] U.S. Cl. ..... 354/303; 354/314; 354/318

[58] Field of Search ..... 354/301, 303, 304, 305, 354/317, 318, 313, 314

[56] References Cited

U.S. PATENT DOCUMENTS

| | | | |
|---|---|---|---|
| 4,307,955 | 12/1981 | Cocco et al. | 354/303 |
| 4,309,100 | 1/1982 | Bendoni et al. | 354/303 |
| 4,325,624 | 4/1982 | Pedroli | 354/304 |
| 4,370,045 | 1/1983 | Holmes | 354/304 |
| 4,375,324 | 3/1983 | Holmes | 354/303 |
| 4,445,770 | 5/1984 | Morse | 354/303 |
| 4,537,485 | 8/1985 | Saito | 354/304 |
| 4,540,263 | 9/1985 | Kramer | 354/318 |

*Primary Examiner*—A. A. Mathews

*Attorney, Agent, or Firm*—Alfred E. Corrigan

[57] ABSTRACT

Apparatus for processing a roll of self-developing type film. The film and a length of flexible sheet material are unwound from their respective spools and laminated to each other with a layer of processing liquid located therebetween prior to being wound as a laminate upon a rotating drum. After the formation of a visible image within the film, a drive train is energized to drive the spools in a direction which unwinds the laminate from the drum and simultaneously rewinds the film and sheet material upon their spools. The drive train is continuously connected to the drives for the spools and includes a clutch arrangement which insures that the rotation of the drum in an unwinding direction is under the control of the sheet material drive while the torque delivered to the film drive keeps the film taut without becoming the dominant force in rotating the drum.

6 Claims, 5 Drawing Figures

FILM PROCESSOR

BACKGROUND OF THE INVENTION

1. Field of the Invention

This invention relates to an apparatus for processing an exposed roll of instant or self-developing type film so as to initiate the formation of a visible image therein.

2. Description of the Prior Art

The present invention relates to apparatus for processing an exposed roll of 35 mm film, preferably of the instant or self-developing type transparency film, and more particularly to an improved drive train for rotating various members of the processing apparatus. The apparatus is compact, inexpensive, easy to use and is especially attractive to the photographer who desires to process his own film.

An example of a processing apparatus of the general type described above may be found in U.S. Pat. No. 4,370,045. This apparatus includes first and second drive spindles which are adapted to (1) rotatably support a film spool and a sheet material spool, respectively, during an early film processing phase in which sheet material and film are being unwound from their respective spools, and (2) drive or rotate the spools during a latter processing phase so as to rewind the film and sheet material upon their respective spools. The apparatus also includes a manually operative lever for moving gears into and out of a gear train, depending upon which processing phase is to take place next, and a hand crank for driving various elements of the processor. Such an arrangement involves more than a small amount of engineering acumen to insure the proper movement and meshing of the gears as well as the full attention of the operator of the processor when he is moving the aforementioned lever between its two operative positions. Should the lever be in the wrong position during initial rotation of the crank, the photographically exposed film will be withdrawn from its cassette and then rewound into the cassette with any processing liquid being applied thereto. Thus, when the operator removes the film cassette at the end of the "processing phase" (which didn't occur) and withdraws the film from the cassette it will be further exposed by the ambient light. Also, if the mechanism for shifting the gears is in the wrong position when a processing kit is loaded into the processor and the loading door shut, it, the loading door, may be inadvertently locked in the closed position and a special tool may be needed to unlock the loading door. Still further, if the operator were to now move the lever into its other position, it is possible that the processing kit may be broken by the processor's pod breaking roller since the housing of the kit will be in a closed position.

A motorized version of a film processor of the type under discussion is shown in U.S. Pat. No. 4,537,485. This processor does address itself to some of the problems described above with reference to the '045 processor. However, the '485 processor includes a drive system in which a one-way clutch is located between a sheet material spindle and a motor, and between a film spindle and the motor. It appears that these one-way clutches allow the film spindle and the sheet material spindle to freely rotate during the winding of the film and sheet material upon a winding shaft, thus possibly leading to a condition wherein a greater amount of either, or both, of the film and the sheet material is being unwound from its respective spool, vis-a-vis, the amount being wound upon the winding shaft. Further, the '485 processor does not appear to have any structure whereby slack in the length of the film (leader) between its cassette and its point of attachment to the processor's winding shaft can be removed without also increasing the tautness of the web of sheet material.

Still another film processor similar to that shown in the '045 patent is the AutoProcessor, sold by Polaroid Corporation of Cambridge, Mass. As diagrammatically depicted in FIG. 4 of the present application, this processor includes a drive train which comprises structure for removing slack in the film leader during loading without materially affecting the tautness in the underlying length of sheet material. However, it does suffer the aforementioned disadvantages of having a drive system wherein various elements are manually moved into and out of the drive system during different phases of the processing cycle.

SUMMARY OF THE INVENTION

The present invention relates to a compact, portable apparatus which is specifically constructed for use by an individual, such as an amateur photographer, in the processing of individual rolls of instant or self-developing film, preferably of the transparency type enclosed in a film cassette of a design readily receivable by conventional 35 mm cameras. More particularly, the invention resides, at least in part, in an improved drive system for the processor. To obviate the aforementioned problems, the present processor includes a drive system which continuously interconnects the drive spindles for the sheet material spool and the film spool. The drive system includes a clutch arrangement which permits; (1) the rotation of the film spindle to take up any slack in the film leader immediately after its attachment to a rotatable drum without also materially affecting the tautness of the underlying sheet material, despite the continuous interconnection of the sheet material and film spindles; (2) the sheet material spindle to be driven at a rate which controls the rotation of the drum during a phase in which the sheet material and film are being unwound from the drum while simultaneously allowing for relative rotation beween the spindles; and (3) the film spindle to be rotated at a rate sufficient to maintain a certain degree of tautness in the film during its rewinding onto its spool without transferring a torque to the drum (via the film attachment) which is greater than that being transferred to the drum via the attached sheet material.

An object of the invention is to provide an apparatus for processing individual rolls of film with a drive system which includes a clutch arrangement for maintaining a predetermined relationship between continuously interconnected drive spindles.

Another object of the invention is to provide an apparatus of the type described with a manually operable member for affecting rotation of one of the interconnected spindles without similarily affecting the other spindle.

Still another object of the invention is to provide an apparatus of the type described with means for mounting the clutch arrangement and the manually operable member on a common axis thus conserving space.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
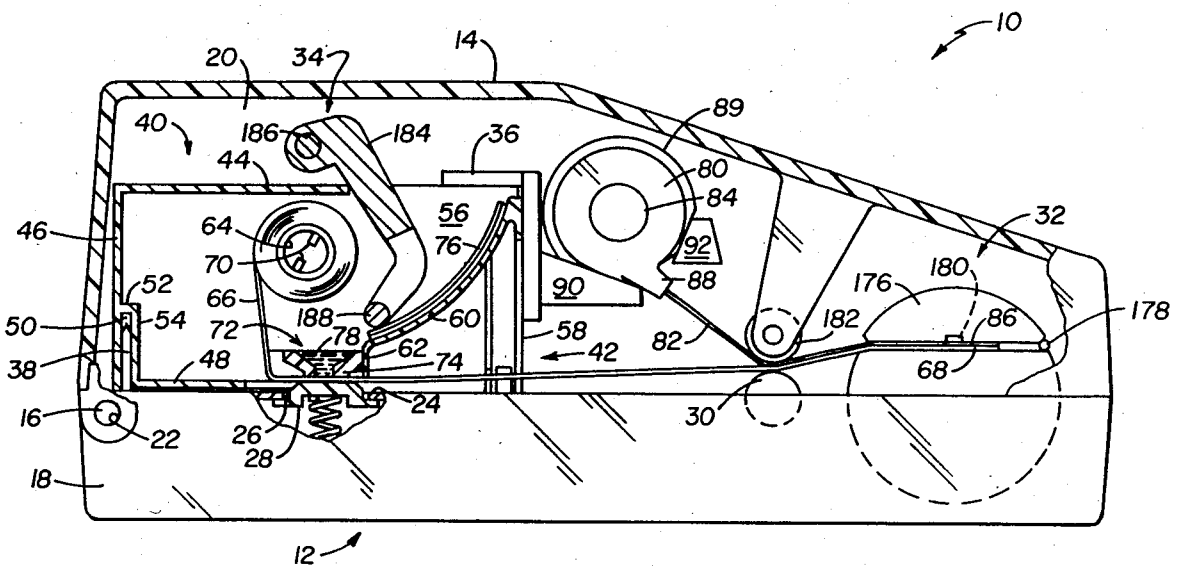
FIG. 1 is a side elevational view, partly cut away, of a preferred form of an apparatus for processing individual rolls of film, the apparatus being shown with various elements omitted or sectioned for reasons of clarity.

Reference is now made to the drawings, and in particular to FIG. 1 wherein is shown an apparatus 10 for processing individual rolls of instant self-developing film, preferably of the 35 mm transparency type. The apparatus 10 includes a housing 12 having a loading door 14 pivotally coupled at one end thereof by a pair of pins 16 (only one being shown) which extend outwardly from opposite side walls 18 and 20 of the housing 12 and are received by apertures 22 (only one being shown) in the loading door 14. Movement of the loading door 14 into its closed position renders the housing 12 lighttight.

A generally horizontal support 24 extends outwardly from the side wall 18 and includes a first opening 26 through which a spring-biased plate 28 is adapted to extend, a second opening (not shown) through which a portion of a roller 30 is adapted to extend, and a third opening (not shown) through which a portion of a take-up roller or drum 32 is adapted to extend. Both the roller 30 and the take-up roller 32 are suitably mounted for rotation about their respective axes by means not shown.

The apparatus 10 also includes means for locating a film processing kit 34 in its proper position relative to other elements of the apparatus 10. Generally, these means include an L-shaped flange 36 which extends inwardly from the side wall of a gearbox (not shown) and an arm 38 which extends at a right angle to the side walls 18 and 20.

The film processing kit 34 includes a housing consisting of a first section 40 and a second section 42 which is constructed to telescopically receive the first section 40. The first section includes a top wall 44, an end wall 46, and a bottom wall 48. The end wall 46 includes a passageway 50 formed by a generally horizontal flange 52 and a vertical flange 54 for receiving the arm 38. The bottom wall 48 has a length slightly less than one-half that of the top wall 44.

The second section 42 includes a pair of side walls 56 (only one being shown) interconnected at one end by an end wall 58. A gently curving wall 60 extends between the side walls 56 and slopes downwardly from the top of the end wall 58 to a point where it terminates in a generally vertical wall 62. A spool 64 is adapted to be rotatably supported between the side walls 56. A length of flexible sheet material 66, e.g., a polyester film such as Mylar having a gelatin coating on one side, is coiled about the spool 64 with a trailing end secured to the spool 64 and a leading end or leader 68 which is adapted to be releasably attached to an exterior surface of the end wall 58 prior to being placed within the apparatus 10. An opening (not shown) is located in the far side wall 56 in alignment with the end of the spool 64 so as to enable a drive member or spindle to protrude therethrough and drivingly engage a pair of tangs 70 on the spool 64. As will be further explained later.

Also mounted in the second section 42 is a processing liquid dispenser 72. The dispenser 72 includes a nozzle 74 which has a length which is less than the width of the sheet material 66 and is approximately equal to the distance betweeen laterally spaced sprocket holes in a strip of 35 mm film, i.e., two and one-half centimeters.

A container 76 having a rupturable lower end is supported on the wall 60 by any suitable means, e.g., by a strip of adhesive tape. The container 76 holds a supply of viscous processing liquid 78, the quantity of which is sufficient to coat substantially the entire length of the gelatin coated side of the sheet material 66. For more details of the disposable processing kit 34, reference should be had to the aforementioned '045 patent.

The apparatus 10 further includes means for supporting a film cassette 80 containing a roll of exposed, self-developing type transparency film 82, the film being wound upon a rotatable film spool 84 with one end of the film being secured to the film spool 84 and its opposite end or leader 86 being adapted to extend to the exterior of the film cassette via a film withdrawal slot 88. These means include a semi-annular flange 89, which is adapted to receive in endwise fashion the general cylindrical film cassette 80, and a pair of supports 90 and 92.

Figure 4:
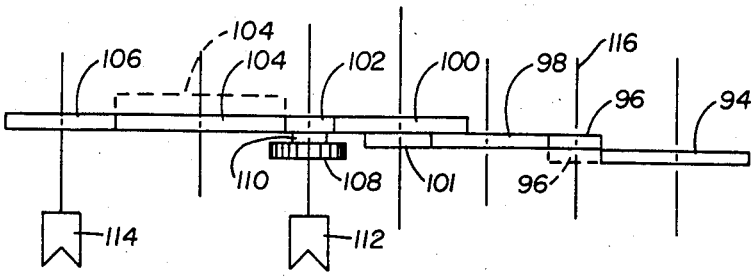
FIG 4 (PRIOR ART)
FIG. 4 is a top elevational view of a portion of a drive system in a prior art processing apparatus.

Before continuing with the description of the present invention, it is thought that a more detailed description of the power train of the aforementioned Polaroid AutoProcessor would now be appropriate. As depicted in FIG. 4. of the drawings of the present application, the power train includes a series of seven gears 94, 96, 98, compound gear 100 and 101, 102, 104, and 106. The gears 96 and 104 are mounted for axially movement between the solid line position and the broken line position FIG. 4 by manually rotating a lever on the exterior of the processor from a horizontal preprocessing position to a vertical processing position, as in a manner more fully described in the aforementioned '045 patent. The gears 96 and 104 are normally located in the solid line position during attachment of the leaders of the film and sheet material to a common take-up roller. If, after such attachment, there is any slack in the film leader, it may be taken up by manually rotating a thumb wheel 108 which is connected to the gear 102 via a clutch 110. Such rotation will rotate a film spindle 112 in the same direction thus taking up the slack in the film. The rotation of the thumb wheel 108 does not materially affect the tautness of the leader of the sheet material because the clutch 110 is located between the thumb wheel 108 and the sheet material spindle 114.

The power train is powered by rotation of a one-way hand crank which is attached to an end of an axle 116 on which the gear 96 is mounted. Thus, when the processor's loading door is closed and the aforementioned lever moved into the processing position, rotation of the crank is effective to drive the common take-up roller via the meshed gears 94 and 96. This rotation is effective to wind the film and sheet material upon the take-up roller as a laminate, with an intermediate layer of the laminate being a coating of processing liquid which had been previously applied to a surface of the sheet material by a processing liquid applicator. The laminate is allowed to remain upon the take-up roller for a period of time, e.g., one minute, sufficient to form a visible image within the film. The aforementioned lever is then manually returned to its original horizontal position, thus causing the gears 96 and 104 to move into their solid line position. Renewed rotation of the hand crank is now directed away from the take-up roller and to the film and sheet material spindles 112 and 114, respectively, thus rotating them in a direction which rewinds the film and sheet material upon their respective spools while simultaneously unwinding the laminate from the take-up roller.

The power train of the processor 10 of the present invention comprises an assemblage 118 which includes a gear 120 that is adapted to be driven when connected to a gear 122 of a motor 124 via an idler gear 126. The gear 120 is continuously in mesh with an idler gear 128 which is in continuous mesh with a gear 130. The gear ratio between the gears 120 and 130 is preferably within the range of 1.5:1 to 2:1, respectively. The drive train is operatively coupled to a first rotating means in the form of a spindle 132 for rotating the film spool 84, and a second rotating means or spindle 134 for rotating the sheet material spool 64. The idler gear 126 is mounted on the end of an arm (not shown) the other end of which is pivotally connected to the apparatus 10 such that it may be pivoted through an arc so as to move the gear 126 from the solid line position of FIG. 5 wherein it is in mesh with the gears 120 and 122, to the broken line position 126', wherein it is in mesh with the gear 122 and a drive gear 136 mounted on the end of a drive shaft 138 connected to the receiving means or take-up roller 32.

Figure 2:
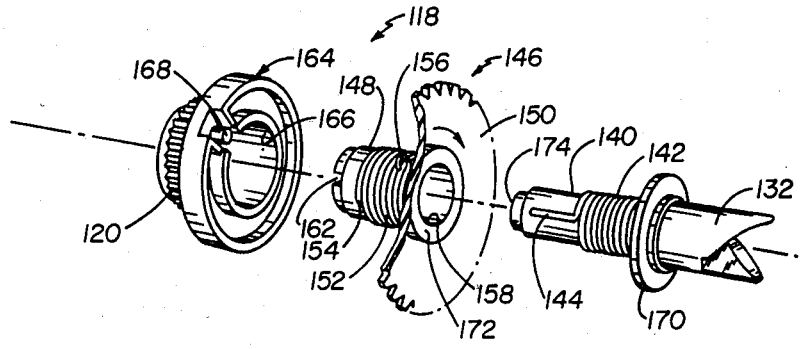
FIG. 2 is partially exploded view of a portion of a drive system for the apparatus shown in FIG. 1.

As best shown in FIG. 2, the assemblage 118 includes a first clutch or torque transferring means comprised of a cylindrically configured shaft 140 extending away from the film spindle 132 and a spring 142 which is coiled about the shaft 140 in a counterclockwise manner until it terminates in an axially extending end 144.

Figure 3:
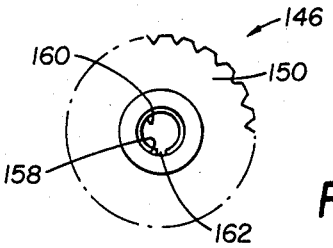
FIG. 3 is an end elevational view of one of the elements shown in FIG. 2.

The assemblage 118 further includes a member 146 having a hollow shaft 148 from which radiates an annular thumb wheel 150. The thumb wheel 150 functions as a manually operable means for removing slack from the film leader 86 during initial loading of the film into the apparatus 10, as will be explained hereinafter. A spring 152 having a first end 154 is wound about the shaft 148 in a clockwise direction until it terminates in a second end formed with a loop 156. The spring 152 and the shaft 148 comprise a second clutch which functions to prevent the thumb wheel 150 from transferring any meaningful rotation to the gear 120 and thus to the sheet material spindle 134 during rotation of the thumb wheel 150 in a clockwise manner, as indicated by the arrow in FIG. 2. The shaft 148 has a larger diameter opening 158 at one end thereof than that of the opening 160 at its opposite end, as best seen in FIG. 3. The material forming the smaller diameter opening 160 is provided with an axially extending slot 162 which is adapted to receive the end 144 of the spring 142 when the shaft 140 is located within the hollow member 146.

Figure 5:
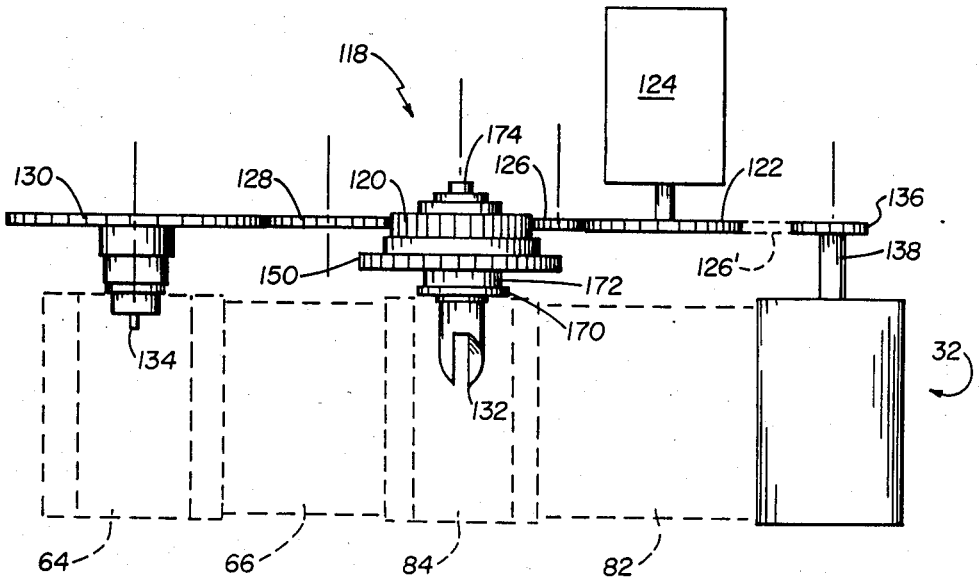
FIG. 5 is a top elevational view of a portion of the drive system of the apparatus of FIG. 1.

The assemblage 118 also includes an annular or ring shaped member 164 on which is integrally formed the gear 120. A passageway 166 extends completely through the member 164 and is adapted to slidably and rotatively receive the shaft 148. A pin 168 is integrally formed on one face of the member 164 and is adapted to be received within the loop 156 when the assemblage 118 is operatively assembled, as shown in FIG. 5. Insertion of the shaft 140 into the shaft 148 is limited by engagement of an annualr flange 170 with a similar flange 172 on the member 146. Thus engaged, an end 174 of the shaft 140 will barely extend through the member 164.

Processing a roll of the film 82 is accomplished by opening the loading door 14 of the apparatus 10 and placing the disposable processing kit 40 within the apparatus 10 with the wall 58 of the kit 40 located closely adjacent to the L-shaped member 36. The take-up spool 32 is then rotated into the position shown in FIG. 1 wherein a cover 176 is rotated about a pivot 178 to an open position wherein an aperture in the sheet material leader 68 may be secured about an upstanding pin 180 on the take-up roller 32 and the leader 68 made taut by rotating the gear 130 in the appropriate direction. Next, the film cassette 80 is located within the apparatus 10 as shown in FIG. 1 with its film leader 86 also secured to the pin 180. Any slack in the film leader 86 may be removed by manually rotating the thumb wheel 150 in the direction of the arrow shown in FIG. 2. Such rotation has a tendency to cause the spring 142 to attempt to unwind or loosen its grip on the shaft 140, thus causing the spring 142 to rotate about the shaft 140. This is a result of the slot 162 in the member 146 and the entrapped spring end 144 rotating in a clockwise manner. Thus, ordinarily no torque would be delivered to the film spindle 132. However, the spring 142 and the shaft 140 are engineered to provide for the transmission of a limited amount of torque to the film spindle 132 before the spring 142 slips or rotates relative to the shaft 140. In the instant arrangement, such slippage will take place just before the torque to be transmitted reaches a level sufficiently high enough to cause rotation of the take-up roller 32 in a counterclockwise direction, as viewed in FIG. 1. Rotation of the thumb wheel 150 in the clockwise direction is not transferred to the sheet material spindle 134 because such rotation is effective to cause the spring 152 to release its grip on the shaft 148. This slippage is a result of the connection between the pin 168 and the looped end 156 of the spring 152 causing the latter to unwind slightly thus materially lessening its grip on the shaft 148. Once the film leader 86 is taut, the loading door 14 is closed thereby moving a freely rotatable roller 182 attached to the door 14 into superposition with the roller 30. During the closing of the loading door 14 suitable means (not shown) move the arm 38 rearwardly into the position shown in FIG. 1, thus opening the kit 40 while simultaneously pivoting a pair of arms 184 (only one shown) about a hinge 186 thereby causing a roller 188, supported between the ends of the arms 184, to rupture the container 76 and force the processing liquid 78 into the reservoir 72. At this point the apparatus 10 appears substantially as shown in FIG. 1.

Upon closure of the loading door 14, the gear 126 is moved into its broken line position 126' and the motor 124 energized, thus driving the take-up roller 32 in a clockwise direction. Such rotation of the take-up roller 32 is effective to unwind the exposed film 82 and the sheet material 66 from their respective spools 84 and 64. A coating of processing liquid 78 is applied to the gelatin coated surface of the sheet material 66 as it is moved past the nozzle 74 of the applicator 72. The coated length of sheet material 66 is then laminated to the emulsion side of the film 82 as the two are moved between the rollers 30 and 182. The resultant laminate is then wound upon the take-up roller 32 for a period of time sufficient for the processing liquid 78 to imbibe the emulsion layer of the film 82 and initiate the formation of a visible image within the film, such period of time preferably being approximately one minute. The completion of the winding of the laminate upon the take-up roller 32 may be detected by any suitable means, such as an increase in the tautness of the film 82 or the sheet material 66, and the motor 124 deenergized accordingly. After the end of the aforementioned period of time, the gear 126 is shifted to its solid line position, as shown in FIG. 5, and the motor 124 is again energized so as to drive the film spindle 132 and the sheet material spindle 134 in directions which will remove the laminate from the take-up roller 32 as the latter rotates in a counterclockwise direction. This counterclockwise rotation of the take-up roller 32, against its resistance to such rotation, is under the control of the torque being applied to the sheet material spool 64 by the spindle 134, and thus to the take-up spool 32 via the attached sheet material 66. The torque being applied to the film spool 84 at this time by the film spindle 132 is just sufficient to prevent any slack from forming in the film 82 as it is being stripped from the sheet material 66, and in no event reaches a level where the pulling force on the film 82 becomes the primary force in rotating the take-up roller 32. For example, the spring 142 is designed to release its grasp on the shaft 140 when a torque of four inch ounces plus or minus one inch ounce (4" oz±1" oz) is applied to the spring 142. More specifically, in the rewinding phase of the processor the motor 124 drives the gear 120 in a clockwise direction, as viewed in FIG. 2. Clockwise rotation of the gear 120 is transferred to the member 146 via the pin 168 and loop 156 connection thus causing clockwise rotation to the member 146. Clockwise rotation of the member 146 is transferred to the film spindle 132 via the slot 162 and spring end 144 connection only until the torque exceeds the above-noted value. Once this value is exceeded, the spring 142 will enlarge slightly in diameter and lose its frictional grip on the shaft 140 thereby resulting in interruption of the drive to the film spindle 132.

After the developed film 82 and the sheet material 66 have been rewound upon their respective spools 84 and 64, the motor 124 is deenergized, the door 14 opened, and the film cassette 80 containing the processed film 82 removed from the apparatus 10. The movement of the door 14 to its open position may be used to move the arm 38 from the position shown in FIG. 1 to the right thus moving the first section 40 of the kit 34 into closing relation with the second section 42 as the arms 184 are simultaneously moved out of the kit 34. The closed kit 34 containing the spent sheet material 66 along with the attached film emulsion layer, which stayed with the sheet material 66 during the stripping operation, may now be safely discarded.

Since certain changes may be made in the above-described apparatus without departing from the scope of the invention herein involved, it is intended that all matter contained in the above description or shown in the attached drawings shall be interpreted as illustrative and not in a limiting sense.

What is claimed is:

1. Apparatus for receiving a film cassette containing a roll of exposed, self-developing type film preparatory to processing the film, the roll of film being wound upon a rotatable film spool with a first end of the film being secured to the spool and its opposite second end being adapted to extend to the exterior of the film cassette via a film withdrawal slot, said apparatus comprising:

a housing defining a lighttight enclosure in which photographically exposed film is adapted to be processed, said housing including a loading door providing access to the interior of said housing;

first means within said housing for rotating the film spool within the film cassette containing the exposed roll of film;

second means within said housing for rotating a spool having a length of flexible sheet material wound thereupon with a first end thereof secured to the spool, and a second free end, the sheet material being adapted to carry a coating of processing liquid on one side thereof prior to being laminated to the film;

means for receiving the second ends of the film and sheet material, said receiving means being adapted to be rotated in a direction so as to unwind the film and sheet material from their respective spools and wind them as a laminate upon said receiving means with the coating of processing liquid being an intermediate layer of the laminate;

a drive train continuously connecting said first and second rotating means and adapted to drive said first and second rotating means in a direction which will cause said second rotating means to rotate said receiving means in a direction so as to unwind the laminate from the receiving means and rewind the film and sheet material upon their respective spools when said loading door is closed, said drive train includes means for transferring torque to said first rotating means at a level sufficient to maintain tautness in the film being rewound but below that which would rotate said receiving means at a rate faster than said second rotating means rotates said receiving means.

2. Apparatus as defined in claim 1 wherein said drive train includes manually operable means coupled to said first rotating means via said torque transferring means for removing any slack in the length of film being attached to said receiving means.

3. Apparatus as defined in claim 2 wherein said drive train further includes means for preventing operation of said manually operable means from transferring any substantial rotation to said second rotating means.

4. Apparatus as defined in claim 3 wherein said preventing means and said torque transferring means each comprise a clutch.

5. Apparatus as defined in claim 3 wherein said preventing means comprises a clutch for preventing said second rotating means from driving said first rotating means when said receiving means is being rotated in a direction so as to unwind the film and sheet material from their respective spools, thereby preventing an excess of film from being unwound from its spool relative to the sheet material.

6. Apparatus as defined in claim 3 wherein said torque transferring means, said manually operable means, and said preventing means are mounted on a common axis.

* * * * *